US007608168B2

(12) United States Patent
Giesecke et al.

(10) Patent No.: US 7,608,168 B2
(45) Date of Patent: Oct. 27, 2009

(54) ALKANOLAMMONIUM-CONTAINING TRIAZINYL FLAVONATE WHITENERS

(75) Inventors: Heinz Giesecke, Odenthal (DE); Bernhard Hunke, Eitorf (DE)

(73) Assignee: Kemira Oyj (FI)

( * ) Notice: Subject to any disclaimer, the term of this patent is extended or adjusted under 35 U.S.C. 154(b) by 290 days.

(21) Appl. No.: 11/187,735

(22) Filed: Jul. 22, 2005

(65) Prior Publication Data

US 2006/0065381 A1 Mar. 30, 2006

(30) Foreign Application Priority Data

Aug. 6, 2004 (DE) ..... 10 2004 038 578

(51) Int. Cl.
*D21H 21/30* (2006.01)
*C09K 11/06* (2006.01)

(52) U.S. Cl. ..... 162/162; 162/135; 162/158; 162/184; 427/158; 252/301.23

(58) Field of Classification Search ..... 162/135, 162/158, 162, 184; 427/158; 252/301.23
See application file for complete search history.

(56) References Cited

U.S. PATENT DOCUMENTS

| | | | | |
|---|---|---|---|---|
| 3,931,422 | A * | 1/1976 | Bateman et al. | 427/424 |
| 4,025,507 | A * | 5/1977 | Fleck et al. | 544/193.2 |
| 4,717,502 | A * | 1/1988 | Schmid | 252/301.23 |
| 5,478,631 | A * | 12/1995 | Kawano et al. | 428/32.1 |
| 5,873,913 | A * | 2/1999 | Cowman et al. | 8/648 |
| 6,165,973 | A * | 12/2000 | Baker | 510/516 |
| 6,723,846 | B1 * | 4/2004 | Metzger et al. | 544/193.2 |
| 6,797,752 | B1 * | 9/2004 | Rohringer | 524/100 |
| 7,258,815 | B2 * | 8/2007 | Drenker et al. | 252/301.35 |
| 2001/0014989 | A1 * | 8/2001 | Rohringer et al. | 8/657 |

FOREIGN PATENT DOCUMENTS

| | | | |
|---|---|---|---|
| EP | 1355004 | * | 10/2003 |
| GB | 896533 | * | 5/1962 |
| WO | 0046336 | A1 | 8/2000 |
| WO | 02097193 | A1 | 12/2002 |

OTHER PUBLICATIONS

European Search Report; EP1624105A1; Nov. 16, 2005; 2 pages.

* cited by examiner

*Primary Examiner*—Eric Hug
*Assistant Examiner*—Dennis Cordray
(74) *Attorney, Agent, or Firm*—Cantor Colburn LLP

(57) ABSTRACT

A process for whitening paper in a size press includes contacting a cellulose sheet with a size press liquor that contains a surface size and a particular whitener containing sulfonate groups and cations, M, wherein at least 10% of all cations M have the formula (II)

in which $R^5$ to $R^7$, independently of one another, denote hydrogen, a $C_1$-$C_4$-alkyl radical or an optionally further substituted $C_2$-$C_4$-hydroxyalkyl radical, and $R^8$ denotes an optionally further substituted $C_2$-$C_4$-hydroxyalkyl radical. The process provides superior paper whitening compared to a corresponding process in which the whitener cations are all sodium or potassium ions.

11 Claims, No Drawings

ALKANOLAMMONIUM-CONTAINING TRIAZINYL FLAVONATE WHITENERS

The invention relates to a process for whitening paper in the size press, whitener preparations and size press liquors.

In the production of paper, a sizing step which can take place, on the one hand, before the sheet formation in the paper pulp (engine sizing) and, on the other hand, after the sheet formation in the size press is as a rule carried out for achieving good writability and strength. A combination of these two processes is also possible. In one or both production stages of the paper, whitening of the paper pulp or of the paper sheet is usually also carried out by means of optical whiteners, as a rule the size and the whitener being added separately to the paper pulp in the case of pulp application, whereas the whitener is incorporated into the size press liquor and applied together with it to the paper sheet in the case of surface sizing.

The combination of surface sizing and whitening of papers is widely used in the paper-producing industry. This method is widely used particularly in the printing and writing paper segment (copy, inkjet, offset, etc.). In addition to efficient whitening, faster correction (online measurement) of the whiteness to be achieved is also possible. Furthermore, the wet end is protected from additional anionic loads (whiteners) with surface application.

GB-A-896 533 has already described triazinyl flavonate whiteners in the form of K or Na salts as optical whiteners in size press processes for whitening paper. These still have some disadvantages in terms of performance characteristics, in particular in the whiteness.

There is a continuing trend towards surface-sized papers having high whitenesses and therefore the desire for optical whiteners as a size press liquor component which are as effective as possible, in particular those whiteners which do not have the disadvantages of the prior art.

The invention therefore relates to a process for whitening paper in the size press, characterized in that the size press liquor contains a whitener of the formula I

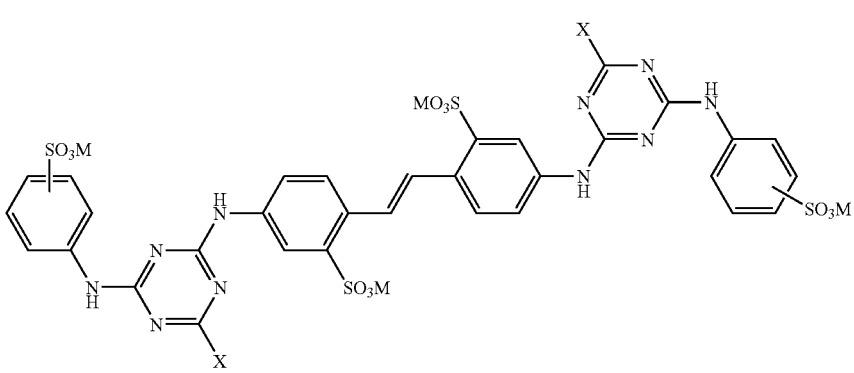

(I)

in which

X, independently of one another, denote a radical of the formula

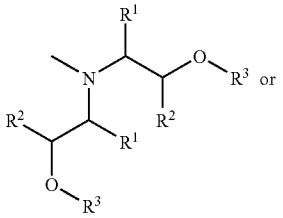

or

-continued

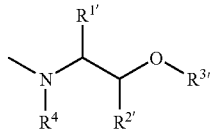

and $R^1$ represents $C_1$-$C_6$-alkyl and $R^2$ represents H, or $R^1$ represents H and $R^2$ represents $C_1$-$C_6$-alkyl, and, independently thereof, $R^3$ represents H, methyl, ethyl, $CH_2CH_2OH$ or $CH_2CH_2OCH_3$, $R^{1'}$ represents $C_1$-$C_6$-alkyl and $R^{2'}$ represents H, or $R^{1'}$ represents H and $R^{2'}$ represents $C_1$-$C_6$-alkyl, and, independently thereof, $R^{3'}$ represents H, methyl, ethyl, $CH_2CH_2OH$ or $CH_2CH_2OCH_3$ and $R^4$ represents $C_1$-$C_4$-alkyl and M denotes H, one equivalent of an inorganic cation, in particular Li, Na, K, Ca, Mg or ammonium, or a substituted ammonium of the formula II

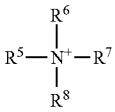

(II)

in which $R^5$ to $R^7$, independently of one another, denote hydrogen, a $C_1$-$C_4$-alkyl radical or an optionally further substituted $C_2$-$C_4$-hydroxyalkyl radical, and $R^8$ denotes an optionally further substituted $C_2$-$C_4$-hydroxyalkyl radical, at least 10 mol % of all cations M corresponding to the formula II.

At least 20 mol %, in particular more than 50 mol %, very particularly preferably 80 mol %, of all cations M preferably have the meaning of the formula II.

It is very particularly preferable to use whiteners which comprise more than 50% by weight, preferably more than 60% by weight, preferably more than 75% by weight, in particular more than 95% by weight, of a whitener of the formula I.

Preferred optical whiteners correspond to the formula (I), in which $R^1$=H, $R^2$=linear $C_1$-$C_6$-alkyl and $R^3$=H;

furthermore to the formula (I), in which $R^{1'}$=H, $R^{2'}$=linear $C_1$-$C_6$-alkyl and $R^{3'}$=H and $R^4$=H or methyl, in which M denotes in each case a mixture of cations containing alkanolammonium ions of the formula II, in which the radicals $R^5$ represent H; $R^6$ represent H or $C_2$-$C_4$-hydroxyalkyl and $R^7$ and $R^8$ represent $C_2$-$C_4$-hydroxyalkyl, and Na or K ions.

The whitener of the formula (Ia)

(Ia)

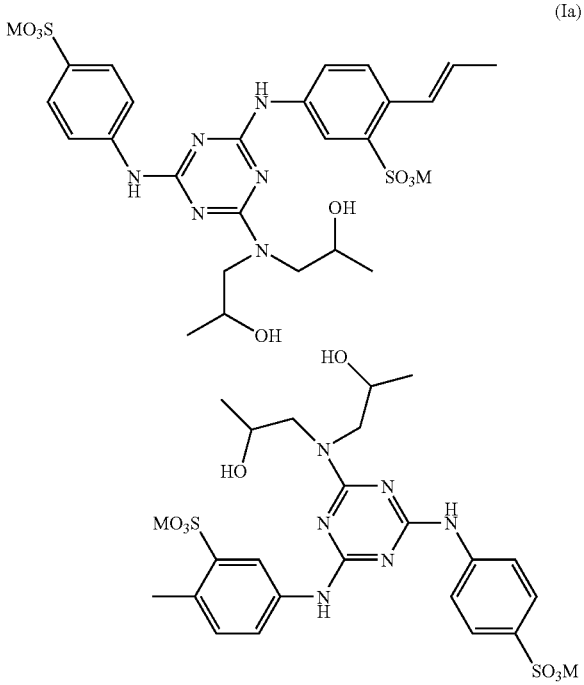

in which

M denotes a mixture containing a cation of the formula II (II)

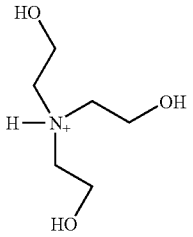

and $Na^+$ or $K^+$, is particularly preferred.

The particular suitability of the alkanolammonium-containing whiteners of the formula I for the use according to the invention means that, where at least one of the radicals $R^5$-$R^7$ is hydrogen, the pH in the size press liquor is preferably adjusted so that a minimum amount of protonated alkanolamine which is optimum for the available amount of whitener anions is available. This is the case in general in the range of pH <=7.5; preferably, a pH at which as far as possible all alkanolamine present is protonated, i.e. a pH range of 4-7, is established in the medium used.

In the case of the use, according to the invention, of the whiteners of the formula (I), excess alkanolamine or alkanolammonium in the form of the free bases or corresponding salts with other, inorganic or organic anions may additionally be present in the size press liquor.

In the context of this invention, size press is understood as meaning a surface application unit, preferably of the paper machine, in which the cellulose sheet formed is brought into contact with an aqueous liquor containing at least one surface size, in particular starch, for example, natural, derivatized or degraded, preferably oxidatively degraded, starch, the so-called size press liquor, and in which the proportion of the liquor which is to be taken up by the sheet (liquor absorption) can preferably be adjusted by means of the roll pressure.

Recent developments of the size press, namely of the Speedsizer as well as of the Symsizer, are likewise understood as being covered by the term size press.

Thus, for example, the whiteners can already be prepared and/or formulated in the form of their alkanolammonium salts or mixed salts comprising their alkanolammonium salts with their salts of inorganic bases and can finally be incorporated in such a form into size press liquors, which are then used in the preferred pH range described. However, they can also be used, for example, by combining a whitener present with an inorganic opposite ion, such as, for example, lithium, sodium, potassium, calcium, magnesium or ammonium, with the salt of an inorganic or organic acid of an alkanolamine, for example an alkanolamine hydrochloride or alkanolamine sulphate, and then using this mixture in a size press liquor of suitable pH, or, for example, by effecting this combination in the size press liquor itself, or, for example, by introducing the alkanolamine on which the alkanolamine salt is based in free form at any desired time and at any desired point into the preparation or processing procedure and neutralizing it in the further course with a suitable inorganic or organic acid. This of course also applies to the opposite case, namely where the inorganic or organic acid is introduced first and the alkanolamine thereafter.

The use according to the invention is preferably effected by introducing an aqueous solution of the whitener used according to the invention, which has a suitable pH and optionally may contain additional substances, such as, for example, carrier substances, salts or standardizing agents, into the size press liquor.

Suitable carrier substances are, for example, hydrophilic polymers having the ability to form hydrogen bridge bonds. Preferred carrier substances are polyvinyl alcohols, carboxymethylcelluloses and polyethylene glycols having a number average molecular weight of from 200 to 8000 g/mol, as well as any desired mixtures of these substances, it being possible for these polymers optionally to be modified. Preferred polyvinyl alcohols are those having a degree of hydrolysis of >85%, preferred carboxymethylcelluloses are those having a degree of substitution DS of >0.5. Polyethylene glycols having a number average molecular weight Mn of from 200 to 8000 g/mol are particularly preferred.

With such formulations, it is possible as a rule to realize more advantageous whiteness build-up curves and higher greening limits than with carrier-free whitener preparations.

In addition, relatively small amounts, usually amounts of less than 5% by weight, of further auxiliaries, such as, for example, dispersants, thickeners, antifreezes, preservatives, complexing agents, etc., or organic byproducts from the whitener synthesis which were not completely removed in the working-up may be contained in the carrier-free or carrier-containing formulations.

If the use of the whiteners shown in formula (I) in a size press application in the form of their salts in which M are only inorganic cations is compared, on the basis of the same extinction, with the alkanolammonium-containing salts, saturation behaviour with regard to the CIE whiteness is found from certain added amounts of the whiteners having only inorganic cations, i.e. larger amounts used lead to no further whiteness build-up and may even adversely affect the whiteness. With the use of the alkanolammonium-containing whiteners, the saturation behaviour occurs only when substantially larger amounts are used compared with the salt having only inorganic cations. Consequently, surprisingly higher whitenesses can be realized with the alkanolammonium-containing formulations than with formulations which contain only inorganic cations. The effect of saturation is also referred to as greening. The greening limit, i.e. the point at which increasing amounts of whitener used result in virtually no further increase in whiteness, can be derived, for example, from the a*-b* diagram, where a* and b* are the colour coordinates in the CIE-L*a*b* system.

Aqueous whitener formulations are usually characterized by the so-called E1/1 value. For this purpose, the extinction of a very dilute solution of the formulation is determined by the customary methods of UV/Vis spectroscopy which are known to a person skilled in the art, in a 1 cm cell at a certain wavelength. This wavelength corresponds to the long-wave absorption maximum of the respective whitener molecule. In the case of flavonate whiteners, it is about 350 nm. The E1/1 value then corresponds to the fictitious extinction value extrapolated to a 1% strength solution of the sample to be determined.

Since the greening of the alkanolammonium-containing types occurs only when relatively large amounts are used, their use according to the invention is particularly suitable for the production of papers having a high degree of whiteness. The exact conditions of use under which the greening begins in the size press application depend on the composition of the respective size press liquor.

EP-A-1355004 likewise describes whiteners of the formula (I), but they are mentioned there only in association with the use in coating slips.

WO 0046336 describes mixtures of whiteners which may contain, inter alia, up to 45 mol % of whiteners of the formula (I) with $R^1$=$R^3$=H; $R^2$=methyl; M=Na, Li, Ca, Mg, ammonium or ammonium which is mono-, di-, tri- or tetra-substituted by $C_1$-$C_4$-alkyl or $C_1$-$C_4$-hydroxyalkyl, inter alia for the whitening of paper. Whether these mixtures are particularly suitable for use in the size press is, however, not mentioned anywhere. Moreover, by comparative investigations, it has been possible to show that, when they are prepared as an individual compound according to the method described in WO 00 46336, example 2, the whiteners of the formula Ia (corresponds to 1b from WO 00/46336) which are described in the present invention have a substantially better whitening effect in the size press application than the mixture according to WO 0046336 prepared in the same manner, and that this effect can be further increased if the excess alkanolamine present is neutralized.

The invention therefore furthermore relates to whitener preparations containing whiteners which comprise more than 50% by weight, preferably more than 60% by weight, preferably more than 75% by weight, in particular more than 95% by weight, of a whitener of the formula I. Aqueous whitener preparations which may optionally also contain additional substances, for example as already mentioned above, are preferred.

The preparations according to the invention can preferably be used in the whitening process according to the invention.

Aqueous whitener preparations containing at least one whitener of the formula (I), in particular (Ia), are particularly preferred.

The preferably aqueous whitener preparations according to the invention preferably contain at least 2.5% by weight of whitener, particularly preferably from 5 to 40% by weight, in particular from 10 to 30% by weight.

Furthermore, the whitener preparations according to the invention may contain inorganic or organic salts, additionally free alkanolamine, additionally alkanolamine salts, carriers and further substances.

The invention furthermore relates to size press liquors containing a) at least one whitener of the formula (I), in particular (Ia), or a whitener preparation according to the invention and b) at least one surface size, preferably starch.

Furthermore, the size press liquor may contain inorganic or organic salts, additionally free alkanolamine, additionally alkanolamine salts, carriers and further substances.

The size press liquor preferably contains less than 2.5% by weight of whitener, in particular from 0.01 to 2.0% by weight. As already described for the whitener preparation, the total whitener comprises more than 50% by weight, preferably more than 60% by weight, preferably more than 75% by weight, in particular more than 95% by weight, of a whitener of the formula I.

The proportion of surface size, in particular starch, based on the size press liquor, is preferably from 2 to 25% by weight, in particular from 5 to 15% by weight.

The proportion of water in the size press liquor is preferably at least 70% by weight.

EXAMPLES

Comparative Example 1

(whitener from GB 896533, example 2, lines 118-122; corresponds to whitener of the formula I of the present Application, the two aniline-bonded sulpho groups being in the p position, with $R^1$=$R^3$=H, $R^2$=$CH_3$, M exclusively Na:

71 g of demineralized water are added while stirring at room temperature to 229 g of a membrane-filtered aqueous concentrate having a E1/1 value of 148 and a pH of 8.5, which contains the whitener of the formula I with $R^1$=$R^3$=H, $R^2$=$CH_3$, M exclusively Na, the two aniline-bonded sulpho groups being in the p position, and the pH is adjusted to 9.0 with about 10% strength sodium hydroxide solution. An aqueous whitener preparation having a E1/1 value of 113 is obtained in the form of a yellow-brownish homogeneous liquid. This corresponds to a whitener content of about 21%.

Comparative Examples 2a, b (corresponds to comparative example 1, except that different amounts of free triethanolamine are additionally used):

a) 15.0 b) 30.0 and a) 56 g b) 41 g of demineralized water are added while stirring at room temperature to 229 g of the membrane-filtered aqueous concentrate from comparative example 1 and then stirred for 10 min. Triethanolamine-containing whitener preparations having a E1/1 value of 113 are obtained in the form of yellow-brownish homogeneous liquids. This corresponds to a whitener content of about 21% and a triethanolamine content of a) 5% b) 10%.

Comparative Example 3 corresponds to example 2 from WO 00 46336.

Examples 1a, 1b 1200 g of the membrane-filtered aqueous concentrate from comparative example 1 are evaporated down in vacuo. After homogenization, the crystals obtained have a E1/1 value of 472.

In each case a mixture of a) 140 g of demineralized water and 15 g of triethanolamine, b) 90 g of demineralized water and 30 g of triethanolamine, is adjusted to pH 6 by adding a) about 36 g b) about 73 g of 10% strength hydrochloric acid. In each case 71.8 g of the crystals described above are then introduced at about 60° C. while stirring. Stirring is continued until the crystals dissolve, which is determined by the respective E1/1 value, and dilution is then effected with demineralized water at room temperature in each case to the same calculated E1/1 value of 113.

In each case about 300 g of a whitener formulation which contains the same number of moles of whitener as comparative examples 1 and 2a, 2b and a) about 5% by weight (corresponds to M with about 50 mol % of triethanolammonium radical $Na^+$) b) about 10% by weight (corresponds to a M with about 100 mol % of triethanolammonium) of triethanolammonium ions.

Example 2

The procedure is as described for example 1b up to and including the introduction of the crystals. After dissolution of the crystals, 15 g of polyethylene glycol 1500 are introduced and are stirred until it dissolves, and the E1/1 value is determined. Dilution is then effected at room temperature with demineralized water to a calculated E1/1 value of 113.

About 300 g of a whitener formulation which contains the same number of moles of whitener and triethanolammonium ions as in example 1b and also 5% of polyethylene glycol 1500 as carrier are obtained.

Example 3 corresponds to example 2 from WO 0046336, except that the preparation of stage 2 is effected not with the mixture of diethanolamine and diisopropanolamine described there but with an amount of diisopropanolamine which is equimolar with this mixture (M=about 50 mol % of triethanolammonium).

Example 4

(corresponds to example 2 from WO 0046336, except that the preparation of stage 2 is effected not with the mixture of diethanolamine and diisopropanolamine described there but with an amount of diisopropanolamine equimolar with the mixture, and additionally excess triethanolamine has been neutralized by establishing pH 6 with hydrochloric acid (M=about 100 mol % of triethanolammonium).

USE EXAMPLES

General Description of the Whitener Test/Size Press Application

Applies to all Use Examples

1. Equipment and Auxiliaries
   Starch solution 10% strength: Perfectamyl A 4692 from Avebe (oxidatively degraded potato starch)
   Test paper: Schleicher and Schuell MicroSience 3014, cut to 240×250 mm pieces, ref. no. 10344684
   Laboratory size press, Foulard: from Mathis, type HF 52499, Zürich Oberhasli, Switzerland 2. Preparation of the Starch Solution
   About 120 g of Perfectamyl A 4692 are suspended without lumps in about 200 ml of cold water. About 700 ml of hot water are then added to the initially taken mixture while stirring, and stirring is continued until a clear starch solution forms. After cooling to room temperature, the concentration is checked by means of a hand refractometer. If necessary, adjust to 10% by adding additional water.

3. Finishing of the Papers
   First, the liquor absorption ratio of the test paper is determined in a separate determination.
   For this purpose, 50.0 g of a 10% starch solution are diluted to 100.0 g with water and thoroughly mixed, the solution is transferred to the laboratory size press and a weighed sheet (weight 1=$m_1$ g) of the test paper described above is passed through the size press. The size press speed should be about 4 m/min and the roll contact pressure about 3 bar. Immediately after passage through the size press, the now moist sheet is weighed again (weight 2=$m_2$ g). The difference $m_2-m_1$ gives the amount of liquor absorbed; based on the weight of the sheet used, the liquor absorption ratio=$(m_2-m_1)$/ml is obtained.
   The individual whitener preparations are then tested by adding the relevant preparation as a concentration series to a further 50.0 g of the same starch solution in each case, diluting to 100.0 g with water, thoroughly mixing, and applying the whitener-containing size press liquors obtained to further test paper sheets as described above with the aid of the laboratory size press. Finally, the papers finished in this manner are dried in a drying cylinder at about 100° C.
   The whitener preparations to be compared are used in each case in a concentration series of 0.5% by weight/1.0% by weight/1.5% by weight/2.0% by weight, based on the weight of the test paper used. The relationship of the concentration of the whitener preparations, based on the weight of the test paper, to the corresponding concentrations based on the amount of size press liquor is established by means of the liquor absorption ratio separately determined beforehand. Thus, for example in the case of a liquor absorption ratio of 0.9 in the experiment described above without whitener, the values of the above concentration series still have to be divided by the divisor 0.9 in order to obtain their values based on the amount of size press liquor.
   Thus, for example with the use of 0.5% by weight of whitener preparation, based on test paper, an amount of 0.55% by weight of whitener preparation, based on the amount of size press liquor, results in the case of a liquor absorption ratio of 0.9.

Furthermore, the above concentration series relates to preparations having a E1/1 value of 113. If preparations having a different E1/1 value are to be tested, the E1/1 value deviation thereof from the guide value 113 must additionally be compensated by changing the concentration series in inverse proportion (example: in the case of a E1/1 value of 105, 0.538% by weight of preparation is equivalent to 0.5% of preparation having a E1/1 value of 113, etc.).

Use Example 1

TABLE 1

| Whitener preparation from comparative example 1 | | | | |
|---|---|---|---|---|
| Amount (%) | CIE whiteness | L* | a* | b* |
| 0.50 | 138.08 | 95.95 | 2.96 | −10.83 |
| 1.00 | 144.11 | 96.12 | 3.04 | −12.13 |
| 1.50 | 145.80 | 96.28 | 2.87 | −12.44 |
| 2.00 | 146.46 | 96.32 | 2.69 | −12.57 |

TABLE 2

| Whitener preparation from comparative example 2a | | | | |
|---|---|---|---|---|
| Amount (%) | CIE whiteness | L* | a* | b* |
| 0.50 | 135.50 | 95.92 | 2.83 | −10.26 |
| 1.00 | 142.76 | 96.12 | 2.98 | −11.82 |
| 1.50 | 144.48 | 96.28 | 2.83 | −12.14 |
| 2.00 | 145.87 | 96.33 | 2.69 | −12.43 |

TABLE 3

| Whitener preparation from comparative example 2b | | | | |
|---|---|---|---|---|
| Amount (%) | CIE whiteness | L* | a* | b* |
| 0.50 | 135.40 | 95.82 | 2.84 | −10.28 |
| 1.00 | 142.37 | 96.11 | 2.97 | −11.73 |
| 1.50 | 144.24 | 96.22 | 2.87 | −12.11 |
| 2.00 | 145.10 | 96.31 | 2.69 | −12.26 |

It is evident that the presence of triethanolamine in the form of the free base results in no improvement of the whitening.

Use Example 2

TABLE 1

| Whitener preparation from comparative example 1 | | | | |
|---|---|---|---|---|
| Amount (%) | CIE whiteness | L* | a* | b* |
| 0.50 | 138.08 | 95.95 | 2.96 | −10.83 |
| 1.00 | 144.11 | 96.12 | 3.04 | −12.13 |
| 1.50 | 145.80 | 96.28 | 2.87 | −12.44 |
| 2.00 | 146.46 | 96.32 | 2.69 | −12.57 |

TABLE 4

| Whitener preparation from example 1a | | | | |
|---|---|---|---|---|
| Amount (%) | CIE whiteness | L* | a* | b* |
| 0.50 | 138.12 | 96.05 | 2.95 | −10.80 |
| 1.00 | 145.36 | 96.31 | 3.09 | −12.33 |
| 1.50 | 146.98 | 96.34 | 2.96 | −12.68 |
| 2.00 | 148.48 | 96.57 | 2.79 | −12.92 |

TABLE 5

| Whitener preparation from example 1b | | | | |
|---|---|---|---|---|
| Amount (%) | CIE whiteness | L* | a* | b* |
| 0.50 | 138.33 | 95.96 | 2.98 | −10.88 |
| 1.00 | 145.58 | 96.26 | 3.12 | −12.40 |
| 1.50 | 147.59 | 96.25 | 3.03 | −12.86 |
| 2.00 | 148.26 | 96.46 | 2.80 | −12.92 |

It is evident that the presence of triethanolammonium results in a substantial improvement of the whitening.

Use Example 3

TABLE 5

| Whitener preparation from example 1b | | | | |
|---|---|---|---|---|
| Amount (%) | CIE whiteness | L* | a* | b* |
| 0.50 | 138.33 | 95.96 | 2.98 | −10.88 |
| 1.00 | 145.58 | 96.26 | 3.12 | −12.40 |
| 1.50 | 147.59 | 96.25 | 3.03 | −12.86 |
| 2.00 | 148.26 | 96.46 | 2.80 | −12.92 |

TABLE 6

| Whitener preparation from example 2 | | | | |
|---|---|---|---|---|
| Amount (%) | CIE whiteness | L* | a* | b* |
| 0.50 | 138.69 | 95.96 | 3.02 | −10.97 |
| 1.00 | 145.83 | 96.23 | 3.16 | −12.47 |
| 1.50 | 148.12 | 96.41 | 3.08 | −12.92 |
| 2.00 | 148.74 | 96.39 | 2.86 | −13.06 |

It is evident that the whitening effect improved by triethanolammonium can be further increased by adding polyglycol.

Use Example 4

(all amounts used are based on a E1/1 value of 113)

TABLE 7

| Whitener preparation from comparative example 3 | | | | |
|---|---|---|---|---|
| Amount (%) | CIE whiteness | L* | a* | b* |
| 0.50 | 137.64 | 95.95 | 2.89 | −10.73 |
| 1.00 | 144.62 | 96.29 | 2.95 | −12.16 |
| 1.50 | 146.04 | 96.37 | 2.78 | −12.45 |
| 2.00 | 147.17 | 96.5 | 2.56 | −12.65 |

TABLE 8

| Whitener preparation from example 3 | | | | |
|---|---|---|---|---|
| Amount (%) | CIE whiteness | L* | a* | b* |
| 0.50 | 137.8 | 95.93 | 2.94 | −10.78 |
| 1.00 | 145.6 | 96.21 | 3.11 | −12.43 |
| 1.50 | 147.6 | 96.32 | 2.96 | −12.82 |
| 2.00 | 148.9 | 96.43 | 2.79 | −13.08 |

TABLE 9

| Whitener preparation from example 4 | | | | |
|---|---|---|---|---|
| Amount (%) | CIE whiteness | L* | a* | b* |
| 0.50 | 138.9 | 95.94 | 2.99 | −11.02 |
| 1.00 | 146.3 | 96.29 | 3.11 | −12.55 |
| 1.50 | 148.4 | 96.39 | 2.97 | −12.98 |
| 2.00 | 149.6 | 96.53 | 2.80 | −13.19 |

It is evident on the one hand that, when used with the same extinction, a whitener preparation which contains the whitener of the formula Ia (having diisopropanolamine radicals on the triazine rings, prepared analogously to example 2 of WO 0046336) has a better whitening effect than the whitener preparation of example 2 of WO 0046336, which contains a whitener mixture which additionally contains a whitener substituted by diethanolamine radicals on the triazine rings and a whitener asymmetrically substituted by diisopropanolamine radicals and diethanolamine radicals on the triazine rings, and, on the other hand, that the whitening effect can be additionally increased if the free triethanolamine which is contained in the whitener preparation prepared analogously to example 2 of WO 0046336 and containing the whitener of the formula Ia is neutralized by addition of acid.

The invention claimed is:

1. A process for whitening paper in the size press, comprising contacting a cellulose sheet with a size press liquor, wherein the size press liquor consists essentially of (a) a whitener of the formula Ia (Ia)

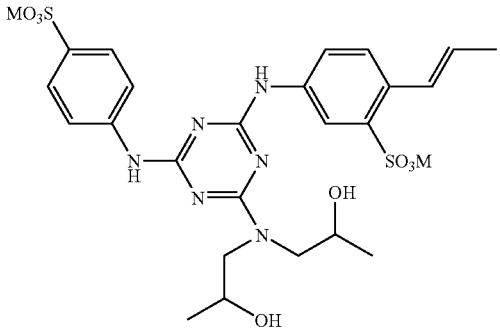

-continued

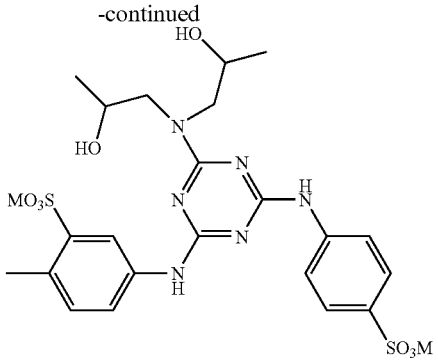

in which

M denotes a mixture containing the cation of the formula II (II)

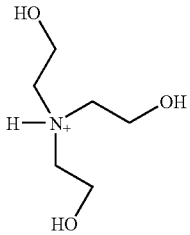

and $Na^+$ or $K^+$, and at least 10 mol % of all cations M correspond to the formula II;

(b) water, (c) surface size, and (d) optionally, starch, carrier substances, salts, standardizing agents, and/or auxiliaries.

2. The process according to claim 1, wherein the size press liquor contains whiteners which comprise more than 50% by weight of a whitener of the formula Ia.

3. The process according to claim 1, and comprising the starch, wherein the starch is natural, derivatized, or degraded starch.

4. The process according to claim 3, wherein the starch is oxidatively degraded starch.

5. The process according to claim 1, wherein the size press liquor comprises the whitener of the formula Ia in an amount of less than 2.5% by weight.

6. The process according to claim 1, wherein the size press liquor comprises the whitener of the formula Ia in an amount of 0.01 to 2.0% by weight.

7. The process according to claim 1, wherein at least 20 mol % of all cations M correspond to the formula II.

8. The process according to claim 1, wherein at least 50 mol % of all cations M correspond to the formula II.

9. The process according to claim 1, wherein at least 80 mol % of all cations M correspond to the formula II.

10. The process according to claim 1, wherein, in Formula Ia, the terminal sulfo groups are each in the para position relative to the aniline nitrogen atom, 50 to 100 mol % of all cations M correspond to the formula II;

and wherein the size press liquor comprises the whitener of the formula Ia in an amount of 0.5 to 2.0% by weight.

11. A size press liquor consisting essentially of:
(a) a whitener of the formula Ia
(Ia)
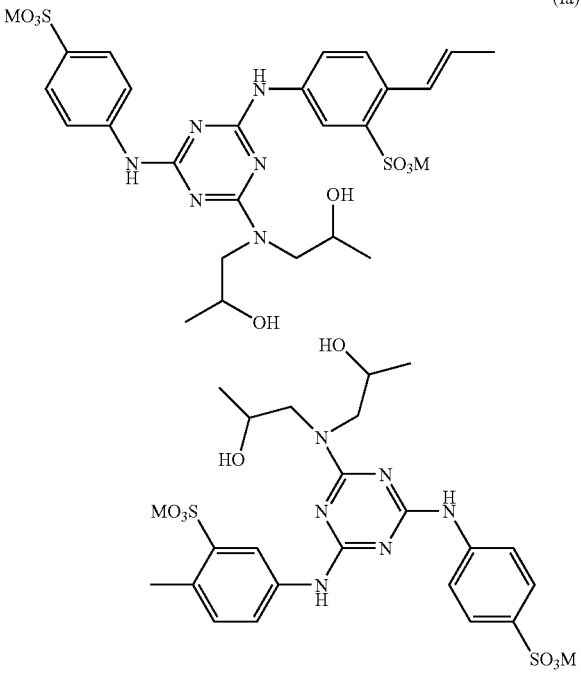
in which
M denotes a mixture containing the cation of the formula II
(II)
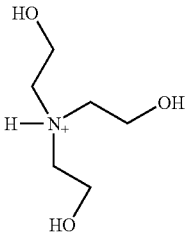
and $Na^+$ or $K^+$, and
at least 10 mol % of all cations M correspond to the formula II;
(b) water,
(c) surface size, and
(d) optionally, starch, carrier substances, salts, standardizing agents, and/or auxiliaries.
* * * * *